US011520270B2

(12) United States Patent
Yamada

(10) Patent No.: US 11,520,270 B2
(45) Date of Patent: Dec. 6, 2022

(54) IMAGING SYSTEM WITH GLOSS TREATMENT DEVICE

(71) Applicant: Hewlett-Packard Development Company, L.P., Spring, TX (US)

(72) Inventor: Takayuki Yamada, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/414,169

(22) PCT Filed: Jan. 14, 2020

(86) PCT No.: PCT/US2020/013493

§ 371 (c)(1),
(2) Date: Jun. 15, 2021

(87) PCT Pub. No.: WO2020/185301

PCT Pub. Date: Sep. 17, 2020

(65) Prior Publication Data

US 2022/0035299 A1 Feb. 3, 2022

(30) Foreign Application Priority Data

Mar. 14, 2019 (JP) ..... JP2019-047398

(51) Int. Cl.
*G03G 15/20* (2006.01)
*G03G 15/00* (2006.01)

(52) U.S. Cl.
CPC ..... *G03G 15/6585* (2013.01); *G03G 15/2017* (2013.01); *G03G 15/2021* (2013.01);
(Continued)

(58) Field of Classification Search
CPC ..... G03G 15/6585; G03G 15/2021; G03G 15/2064; G03G 2215/00805; G03G 2215/2019; G03G 15/2017
See application file for complete search history.

(56) References Cited

U.S. PATENT DOCUMENTS 5,998,761 A * 12/1999 Berkes ..... G03G 15/2064 399/68
7,529,514 B2 5/2009 Tamura et al.
(Continued)

FOREIGN PATENT DOCUMENTS

JP 05046040 A 2/1993
JP 2005313458 A 11/2005
JP 2014123015 A 7/2014

*Primary Examiner* — Walter L Lindsay, Jr.
*Assistant Examiner* — Laura Roth
(74) *Attorney, Agent, or Firm* — Trop Pruner & Hu, P.C.

(57) ABSTRACT

An imaging system with a gloss treatment device includes an endless belt, a heating portion and a pressing portion. The endless belt conveys a medium along a conveyance direction. The heating portion heats the endless belt. The pressing portion presses the endless belt against the heating portion. A nip is formed in a region where the endless belt contacts both of the pressing portion and the heating portion. The nip includes an upstream end and a downstream end in the conveyance direction, and a reference line intersects the upstream end and the downstream end of the nip. The endless belt includes a conveyance portion that is inclined toward the heating portion, in relation to the reference line associated with the nip.

18 Claims, 9 Drawing Sheets

(52) U.S. Cl.
CPC ..... *G03G 15/2064* (2013.01); *G03G 2215/00805* (2013.01); *G03G 2215/2019* (2013.01)

(56) References Cited

U.S. PATENT DOCUMENTS

| | | | | |
|---|---|---|---|---|
| 8,600,276 | B2 | 12/2013 | Ishii et al. | |
| 8,892,015 | B2 | 11/2014 | Kunii et al. | |
| 2002/0102118 | A1* | 8/2002 | Kosugi ..... | G03G 15/2021 399/341 |
| 2004/0042809 | A1* | 3/2004 | Fuma ..... | G03G 15/2064 399/69 |
| 2011/0188911 | A1 | 8/2011 | Kunii et al. | |
| 2012/0201579 | A1* | 8/2012 | Kunii ..... | G03G 15/2021 399/328 |
| 2012/0213562 | A1 | 8/2012 | Yamana | |
| 2012/0328343 | A1 | 12/2012 | Kunii et al. | |

* cited by examiner

IMAGING SYSTEM WITH GLOSS TREATMENT DEVICE

BACKGROUND

Some imaging systems perform a gloss treatment on an image. In such an imaging system, toner fixed on a medium is heated and pressed to be remelted, and is subsequently cooled while in close contact with a smooth belt surface, so as to form a smooth toner surface.

DETAILED DESCRIPTION

In the following description, with reference to the drawings, the same reference numbers are assigned to the same components or to similar components having the same function, and overlapping description is omitted. An imaging system may be one which includes a gloss treatment device used in an imaging apparatus such as a printer or the like, and the gloss treatment device may be provided separately from the imaging apparatus or the like.

Figure 1:
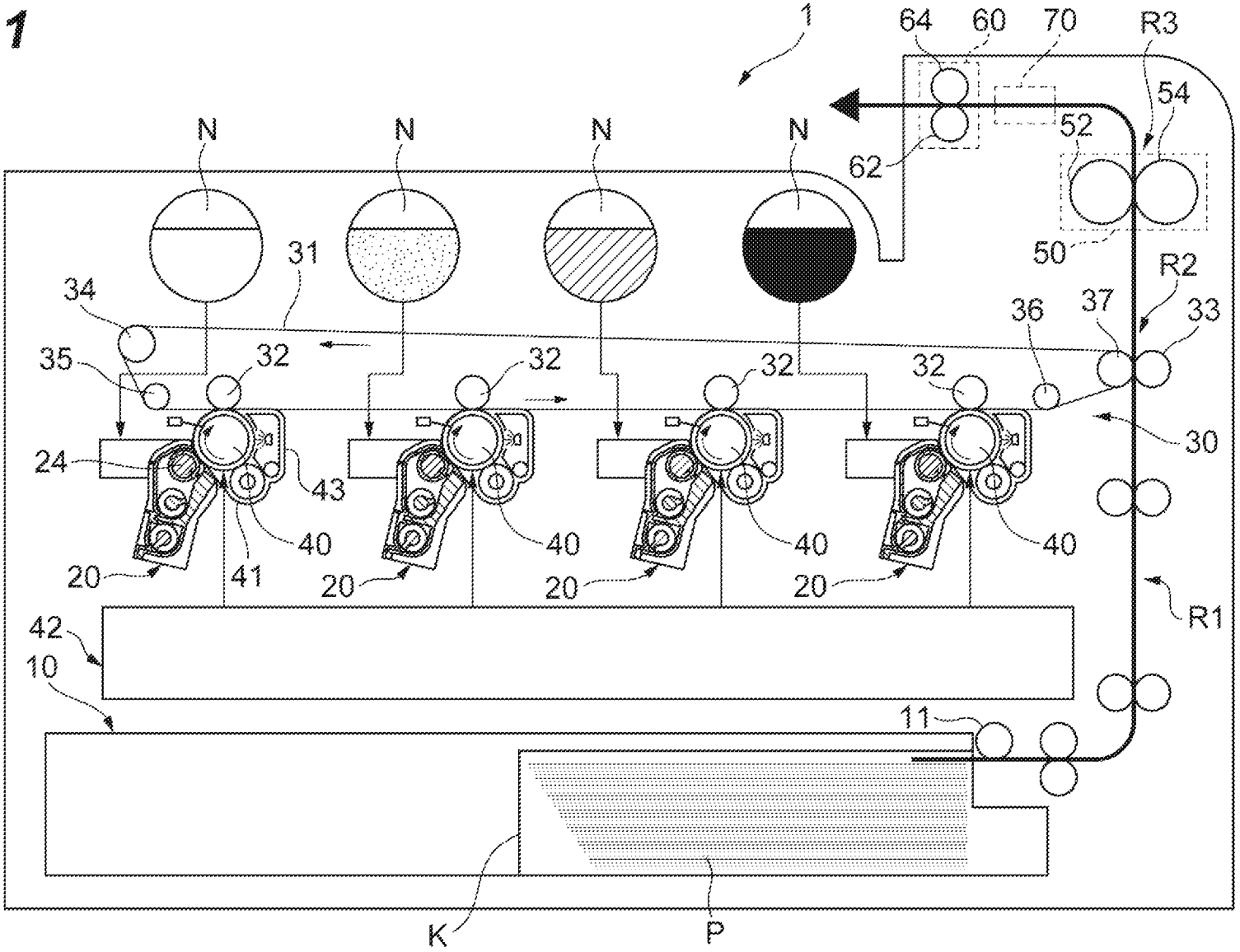
FIG. 1 is a schematic diagram of an example imaging system which can be used to implement various example gloss treatment devices.

FIG. 1 is a diagram illustrating a schematic configuration of an example imaging system 1. The example imaging system 1 may be an apparatus which forms a color image by using respective colors of magenta, yellow, cyan, and black. The imaging system 1 includes, for example, a conveyance device 10 which conveys a sheet P corresponding to a recording medium, a developing device 20 which develops an electrostatic latent image, a transfer device 30 which secondarily transfers toner onto a sheet P, an image carrier 40 which has an electrostatic latent image formed on a surface (a peripheral surface), a fixing device 50 which fixes toner onto the sheet P, and a discharging device 60 which discharges the sheet P.

The conveyance device 10 may convey the sheet P corresponding to a recording medium having an image formed thereon on a conveyance route R1. The sheets P are stacked and stored in a cassette K and are picked up and conveyed by a feeding roller 11. The conveyance device 10 allows the sheet P to reach a transfer nip portion R2 through the conveyance route R1 at a timing at which the toner image transferred to the sheet P reaches the transfer nip portion R2.

Four developing devices 20 may be provided at corresponding positions for the four respective colors. Each developing device 20 may include a developer carrier 24 which carries toner on the image carrier 40. In the developing device 20, for example, a two-element developer including toner and carrier is used as the developer. For example, the toner and the carrier may be adjusted to a selected or predetermined mixing ratio and the toner and the carrier are mixed to uniformly disperse the toner, to achieve an optimal charge amount. The developer is carried on the developer carrier 24. The developer carrier 24 rotates so that the developer is conveyed to a region facing the image carrier 40. Then, the toner in the developer carried on the developer carrier 24 is transferred to the electrostatic latent image that is formed on a peripheral surface of the image carrier 40, so that the electrostatic latent image is developed.

For example, the transfer device 30 secondarily transfers the toner formed by the developing device 20 to the sheet P at the transfer nip portion R2. The transfer device 30 may include a transfer belt 31 to which toner is primarily transferred from the image carrier 40, tension rollers 34, 35, 36, and 37 which tension the transfer belt 31, a primary transfer roller 32 which sandwiches the transfer belt 31 along with the image carrier 40, and a secondary transfer roller 33 which sandwiches the transfer belt 31 along with the tension roller 37.

The transfer belt 31 may be an endless belt which moves in a circulating manner by the tension rollers 34, 35, 36, and 37. Each of the tension rollers 34, 35, 36, and 37 is a roller which is rotatable about each axis. The tension roller 37 may be a drive roller which rotates about an axis in a driving manner. The tension rollers 34, 35, and 36 may be driven rollers which rotate in a driven manner in accordance with the rotational driving of the tension roller 37. The primary transfer roller 32 may be provided to press the image carrier 40 from the inner peripheral side of the transfer belt 31. The secondary transfer roller 33 may be disposed in parallel to the tension roller 37 with the transfer belt 31 interposed therebetween and provided to press the tension roller 37 from the outer peripheral side of the transfer belt 31. Accordingly, the secondary transfer roller 33 forms a transfer nip portion R2 between the secondary transfer roller and the transfer belt 31.

The image carrier 40 is also called an electrostatic image carrier, a photosensitive drum, or the like. Four image carriers 40 may be provided at four positions corresponding to respective colors. The image carriers 40 may be arranged along the movement direction of the transfer belt 31. For example, the developing device 20, a charging roller 41, an exposure unit 42, and a cleaning device 43 may be provided about the circumference of the image carrier 40.

The charging roller 41 may be charging means for uniformly charging a surface of the image carrier 40 to a predetermined potential. The charging roller 41 may rotate to follow the rotation of the image carrier 40. The exposure unit 42 may expose the surface of the image carrier 40 charged by the charging roller 41 based on an image formed on the sheet P. Accordingly, a potential of a portion exposed by the exposure unit 42 in the surface of the image carrier 40 changes so that an electrostatic latent image is formed. In some examples, four developing devices 20 may develop the electrostatic latent image formed on the image carrier 40 by the toner supplied from toner tanks N provided to face the respective developing devices 20 and generate the toner. The respective toner tanks N may be filled with toners of magenta, yellow, cyan, and black. The cleaning device 43 may collect the toner remaining on the image carrier 40 after the toner formed on the image carrier 40 is primarily transferred onto the transfer belt 31.

In some examples, the fixing device 50 allows the sheet P to pass through a fixing nip portion R3 for performing heating and pressing operations so that the toner secondarily transferred from the transfer belt 31 onto the sheet P is attached and fixed to the sheet P. The fixing device 50 may include a heating roller 52 which heats the sheet P and a pressing roller 54 which rotationally drives the heating roller 52 in a pressed state. The heating roller 52 and the pressing roller 54 may be formed in a cylindrical shape and the heating roller 52 may include a heat source such as a halogen lamp provided therein. The fixing nip portion R3 may correspond to a contact region provided between the heating roller 52 and the pressing roller 54. The sheet P may be channeled through the fixing nip portion R3 so that the toner is melted and fixed to the sheet P.

For example, the discharging device 60 includes discharging rollers 62 and 64 which discharge the sheet P to which the toner is fixed by the fixing device 50 to the outside of the apparatus.

An example of printing operations performed by the example imaging system 1 will be described. When an image signal of a target recording image is input to the imaging system 1, a control unit of the imaging system 1 rotates a feeding roller 11 so that the sheet P stacked on a cassette K is picked up and conveyed. Then, the surface of the image carrier 40 is uniformly charged to a predetermined potential by the charging roller 41 (a charging operation). Then, the surface of the image carrier 40 is irradiated with a laser beam by the exposure unit 42 on the basis of the received image signal so that an electrostatic latent image is formed (an exposing operation).

In the developing device 20, the electrostatic latent image is developed so that a toner image is formed (a developing operation). The toner image which is formed in this way is primarily transferred from the image carrier 40 to the transfer belt 31 in a region in which the image carrier 40 faces the transfer belt 31 (a transferring operation). The toner images formed on four image carriers 40 are sequentially layered (or superimposed) on the transfer belt 31 so that a single composite toner image is formed. Then, the composite toner image is secondarily transferred to the sheet P conveyed from the conveyance device 10 in the transfer nip portion R2 in which the tension roller 37 faces the secondary transfer roller 33.

The sheet P to which the composite toner image is secondarily transferred is conveyed to the fixing device 50. Then, the fixing device 50 heats and presses the sheet P between the heating roller 52 and the pressing roller 54 when the sheet P passes through the fixing nip portion R3 so that the composite toner image is melted and fixed to the sheet P (a fixing operation). Then, the sheet P is discharged to the outside of the imaging system 1 by the discharging rollers 62 and 64.

Figure 2:
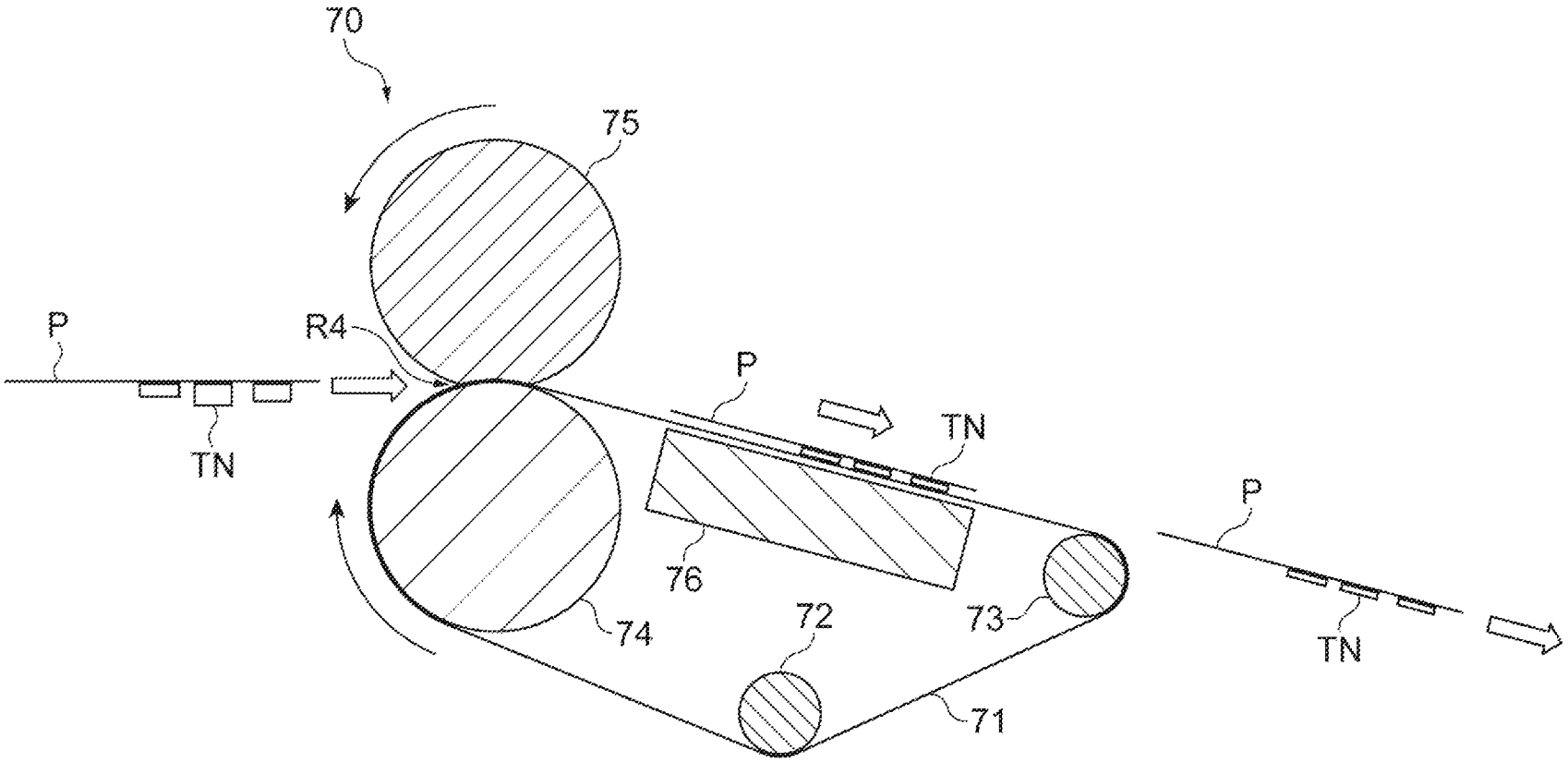
FIG. 2 is a schematic diagram of an example gloss treatment device.

The example imaging system 1 further includes a gloss treatment device 70. FIG. 2 is a schematic diagram of the example gloss treatment device 70. As illustrated in FIG. 2, the gloss treatment device 70 may perform a gloss treatment on the sheet P to which toner TN (that forms the toner image on the sheet P) has been fixed by the fixing device 50. The example gloss treatment device 70 is disposed between the fixing device 50 and the discharging device 60 in the conveyance path (the conveyance direction) of the sheet P (see FIG. 1). In some examples, the gloss treatment device 70 may be attached to the discharging device 60 or may be provided separately from the imaging apparatus (which is a configuration similar to the imaging system 1 illustrated in FIG. 1, with the exception of the arrangement of the gloss treatment device 70). The imaging system 1 may operate in a gloss printing mode and in a normal printing mode. In the gloss printing mode, the sheet P to which the toner TN is fixed by the fixing device 50, is supplied to the gloss treatment device 70. In the normal printing mode, the sheet P to which the toner TN is fixed by the fixing device 50, is discharged while the sheet is not supplied to the gloss treatment device 70. The gloss printing mode and the normal printing mode can be switched by the setting of a user in some examples.

The example gloss treatment device 70 may include a conveyor belt 71 (an endless belt), first and second rollers 72 and 73 (e.g., tension rollers), a heating roller (or heat roller) 74 (e.g., a heating portion), a pressing roller (or pressure roller) 75 (e.g., a pressing portion), and a cooling device 76 (e.g., a cooling portion).

The example conveyor belt 71 is an endless belt which conveys the sheet P. The conveyor belt 71 conveys the sheet P by using the outer peripheral surface as the conveyance path of the sheet P. The outer peripheral surface of the conveyor belt 71 has a smooth surface in order to smoothen the toner TN of the sheet P. The conveyance speed of the conveyor belt 71 may be set to about 5 to 200 mm/sec.

The conveyor belt 71 may be formed in a structure having two layers or more and has a structure including a base material and a release layer or a structure including a base material, an elastic layer, and a release layer. An example material, for a case in which the conveyor belt 71 has a structure including first and second base materials and a release layer will be described. In the example material, the first material has a composition including at least one of resinous base materials of PI, PEEK, and PAI, the thickness is 30 to 150 μm or 50 to 100 μm, and the thermal conductivity is 0.1 to 2 W/mk or 0.2 to 1.6 W/mk. The second base material is formed of an alloy including at least one of SUS, Cu, and Ni, the thickness is 5 to 70 μm or 10 to 50 μm, and the thermal conductivity is 10 to 600 W/mk or 15 to 400 W/mk. The release layer is formed of fluorine-based resin such as PFA or PTFE, the thickness is 5 to 100 μm or 10 to 50 μm, and the surface roughness (Ra) is 0.3 μm or less or 0.1 μm or less.

The first roller 72 and the second roller 73 may be tension rollers which engage with the conveyor belt 71. The arrangement of the first roller 72 and the second roller 73 is an example arrangement. In some examples, a single roller may be provided to engage the conveyor belt. In yet other examples, three or more rollers may be provided to engage the conveyor belt. The second roller 73 is disposed on the upstream side of the first roller 72, in the conveyance direction of the sheet P. The first roller 72 and the second roller 73 are rotatable about respective axes. The first roller 72 and the second roller 73 are disposed on the inner peripheral side of the conveyor belt 71 so as to tension the conveyor belt 71. Each of the first roller 72 and the second roller 73 may be a drive roller or a driven roller. In the conveyor belt 71, the outer peripheral surface between the heating roller 74 and the second roller 73 may be formed as the conveyance path of the sheet P.

The example heating roller 74 is a heating portion which heats the conveyor belt 71, in order to heat the toner TN fixed to the sheet P so that the toner is melted again (e.g., re-melted or melted a second time). For example, the toner TN fixed to the sheet P is heated by the conveyor belt 71 heated by the heating roller 74. The heating roller 74 is disposed between the first roller 72 and the second roller 73 in the conveyance path and is disposed adjacent to the conveyor belt 71 (for example, inside the conveyor belt 71). The heating roller 74 is fixed to, for example, a frame of the imaging system 1. A nip portion (or nip region) R4 for heating and pressing the sheet P is formed between the heating roller 74 and the pressing roller 75. In the nip portion R4, the conveyor belt 71 contacts both of the heating roller 74 and the pressing roller 75. The heating roller 74 is a drive roller. The heating roller 74 may be a driven roller in some examples.

The heating roller 74 is formed of, for example, a metal material such as aluminum or iron and the outer diameter Φ thereof is set to, for example, about 25 to 60 mm. Further, the heating roller 74 may be a structure of two or more layers including a base material formed of a metal material and a release layer.

The example pressing roller 75 is a pressing portion which presses the conveyor belt 71 against the heating roller 74 so that a pressure is applied to the sheet P that is conveyed by the conveyor belt 71 and that passes through the nip portion R4. The pressing roller 75 is disposed adjacent to the conveyor belt 71 in order to apply a pressure to the sheet P. That is, the pressing roller 75 is disposed on the side opposite to the heating roller 74 with respect to the conveyor belt 71 and is pressed against the heating roller 74 with the conveyor belt 71 interposed therebetween by a pressing mechanism. For example, the pressing mechanism may include an urging mechanism which urges the pressing roller 75 toward the heating roller 74 and a support mechanism which supports the pressing roller 75 so as to maintain a state in which the pressing roller 75 is pressed by the heating roller 74. The pressing roller 75 is a driven roller. Furthermore, the pressing roller 75 may be a drive roller.

The example pressing roller 75 has a three-layer structure including a base material, an elastic layer, and a release layer. A heating member may be provided inside the pressing roller 75. The base material of the pressing roller 75 is formed of, for example, a metal material such as aluminum or iron. The elastic layer of the pressing roller 75 is formed of, for example, silicon rubber, the thickness is 0.1 to 20 mm, and the material hardness is 5 to 60 (JIS-A). The release layer of the pressing roller 75 is formed of, for example, fluorine-based resin such as PFA or PTFE and the thickness is set to 5 to 100 μm or 10 to 50 μm. The product hardness of the pressing roller 75 on the whole is set to, for example, 40 to 80 (AskerC). The heating roller 74 is formed of a material (specifically, a metal material) having a hardness greater than that of the pressing roller 75. Accordingly, the pressing roller 75 is formed in a shape that is pressed (e.g., depressed) against the heating roller 74 in the nip portion R4.

The example cooling device 76 is a device which smoothes the toner surface by cooling and solidifying the toner TN that has been re-melted by the heating roller 74. The cooling device 76 is, for example, a heat sink, a cooling fan, a heat pipe, or a peltier device. The cooling device 76 is disposed on the downstream side of the heating roller 74 in the conveyance path. For example, the cooling device 76 is disposed on the inner peripheral side of the conveyor belt 71 and is disposed adjacent to the conveyor belt 71 so as to cool the conveyor belt 71. The toner TN is cooled by the conveyor belt 71 cooled by the cooling device 76.

Figure 3:
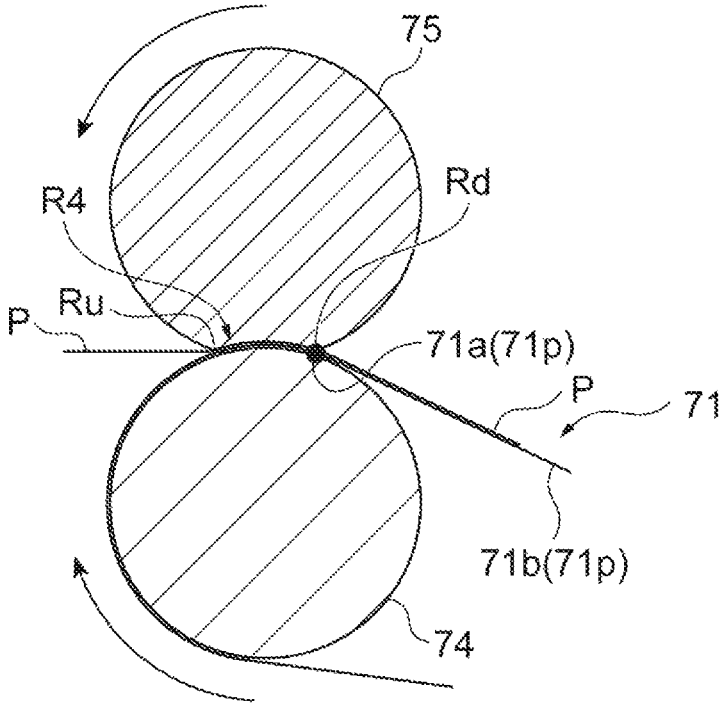
FIG. 3 is a partial enlarged view of the example gloss treatment device illustrated in FIG. 2.
Figure 4:
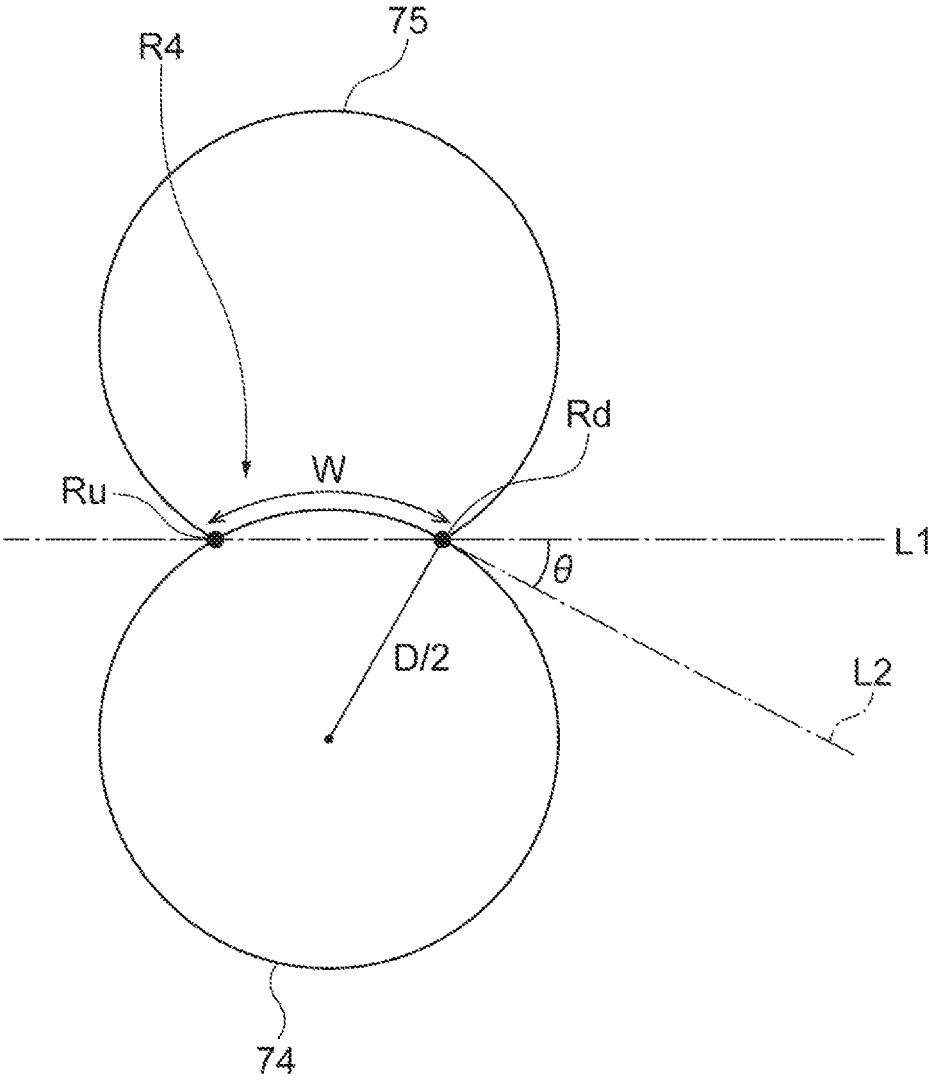
FIG. 4 is a schematic diagram illustrating an inclination angle of an example conveyor belt.

Referring to FIGS. 3 and 4, the nip portion R4 and the conveyor belt 71 on the downstream side thereof will be described. FIG. 3 is an enlarged partial view of the gloss treatment device 70 illustrated in FIG. 2, that schematically illustrates a region near the nip portion R4. FIG. 4 is a diagram that shows an inclination angle of the conveyor belt 71. [0027] As illustrated in FIG. 3, with further reference to FIG. 4, the conveyor belt 71 includes a conveyance portion 71*p* which is inclined by an inclination angle Θ toward the heating roller 74 in relation to a line (or reference line) L1 connecting a nip portion entrance Ru corresponding to an upstream end of the nip portion R4 and a nip portion exit Rd corresponding to a downstream end thereof in the conveyance direction of the sheet P, and the conveyance portion 71*p* extends toward the cooling device 76 (see FIG. 2). More specifically, the conveyance portion 71*p* extends toward the cooling device 76 (see FIG. 2) along a tangent (or tangent line) L2 (see FIG. 4) of the nip portion exit Rd. The reference line L1 may be representative of a first plane, and the tangent L2 may be representative of a second plane that is angularly offset from the first plane. For example, the first plane includes the reference line L1 and extends parallel to a longitudinal direction defined by the rotational axis of the heating roller 74, and the second plane includes the tangent line L2 and extends parallel to the longitudinal direction of the heating roller 74. In some examples, the conveyance portion 71*p* may be further inclined toward the heating roller 74 in relation to the tangent L2 and extend toward the cooling device 76. The conveyance portion 71*p* is located between the nip portion exit Rd and the cooling device 76 in the conveyance direction of the sheet P.

The conveyance portion 71*p* includes a curved portion 71*a* and a linear portion 71*b*. The curved portion 71*a* is a portion which contacts the heating roller 74. The linear portion 71*b* is a portion which is continuous to the curved portion 71*a* (e.g. the linear portion 71*b* extends continuously from the curved portion 71*a*) and extends linearly toward the cooling device 76. In some examples, the upstream end and the downstream end of the nip portion extend longitudinally, parallel to the rotational axes of the heating roller 74 and of the pressing roller 75, and a first plane extending longitudinally intersects both the upstream end and the downstream end of the nip portion. Accordingly, the first plane includes the reference L1. The linear portion 71*b* of the conveyance portion 71*p* extends along a second plane that includes the tangent line L2 and that is angularly offset from the first plane. In some examples, the linear portion 71*b* extends along a third plane that is angularly offset from the second plane between the second plane and the heating roller 74.

Assuming that the linear portion 71*b* extends along the tangent L2 (FIG. 4), the inclination angle of the linear portion 71*b* is an angle (a tangent angle Θ) of the tangent L2 with respect to the line L1 that connects the nip portion entrance Ru and the nip portion exit Rd. The tangent angle Θ is set based on the nip width W and the diameter D of the heating roller 74 (more specifically, a ratio of the nip width W with respect to the diameter D). For example, when the diameter D of the heating roller 74 is set to a range of 25 to 60 mm and the nip width W is set to a range of 4 to 15 mm, the tangent angle Θ is set to a suitable value based on the ratio of the nip width W with respect to the diameter D. When the diameter D and the nip width W are set to the above-described range, the ratio of the nip width W with respect to the diameter D becomes, for example, 0.06 or more. In some examples, the linear portion 71*b* may be angularly offset by 20° from the tangent, toward the heating roller 74. In an example, the linear portion 71*b* is inclined toward the heating roller 74, by 20° more than the tangent angle Θ. In this case, for example, when the diameter D and the nip width W are set to the above-described range, the ratio of the nip width W with respect to the diameter D becomes at least 1 or less. Accordingly, when the diameter of the heating roller 74 is set to a range of 25 to 60 mm and the nip width is set to a range of 4 to 15 mm, the ratio of the nip width W with respect to the diameter D of the heating roller 74 may be set to 0.06 or more and 1 or less in consideration of a case in which the linear portion 71*b* is further inclined toward the heating roller 74 (by 20°) in addition to a case in which the linear portion 71*b* is extended along the tangent L2.

Furthermore, the nip width may be set to 2 to 15 mm or 6 to 12 mm. Further, the internal pressure of the nip portion R4 may be set to 0.04 to 0.5 Mpa. Further, the internal temperature of the nip portion R4 may be set to 100 to 180° C. or 130 to 150° C.

Figure 5:
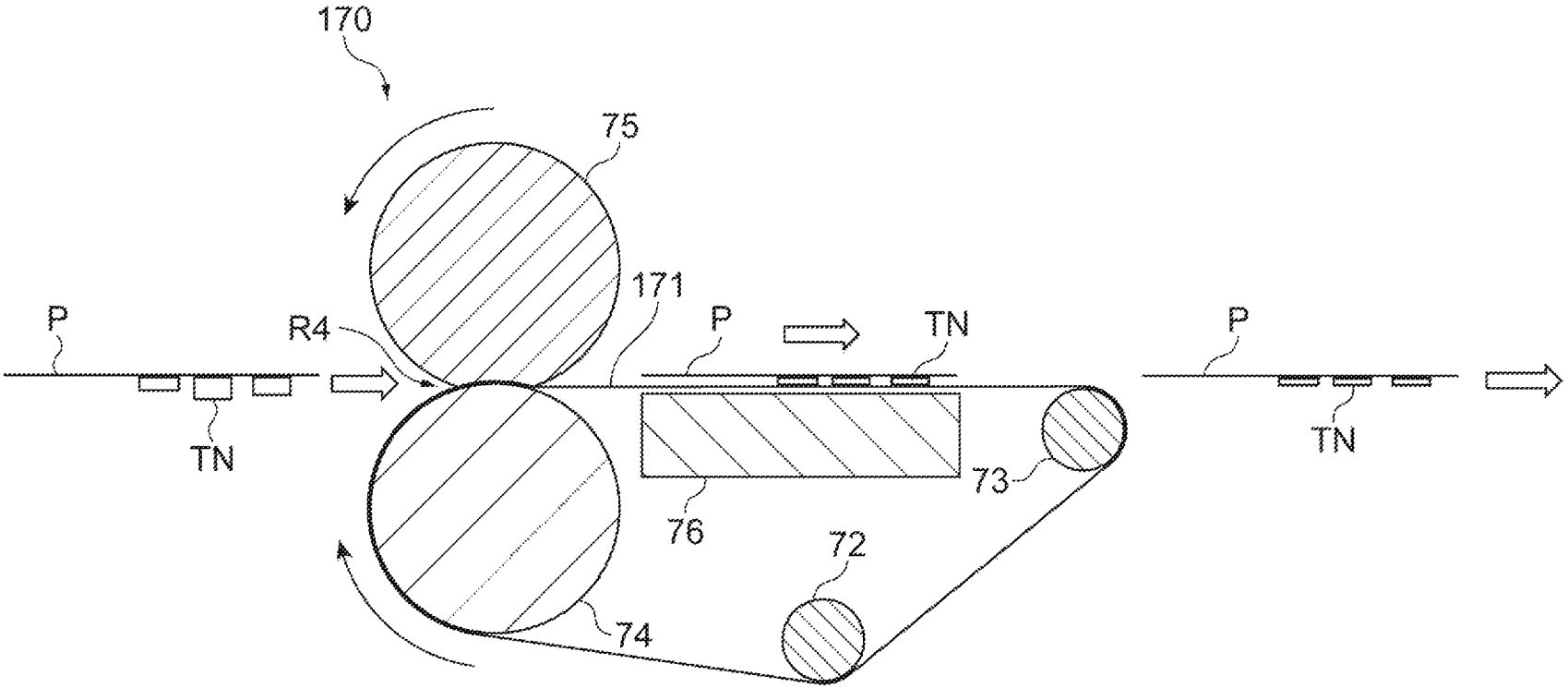
FIG. 5 is a schematic diagram of a gloss treatment device according to a comparative example.
Figure 6:
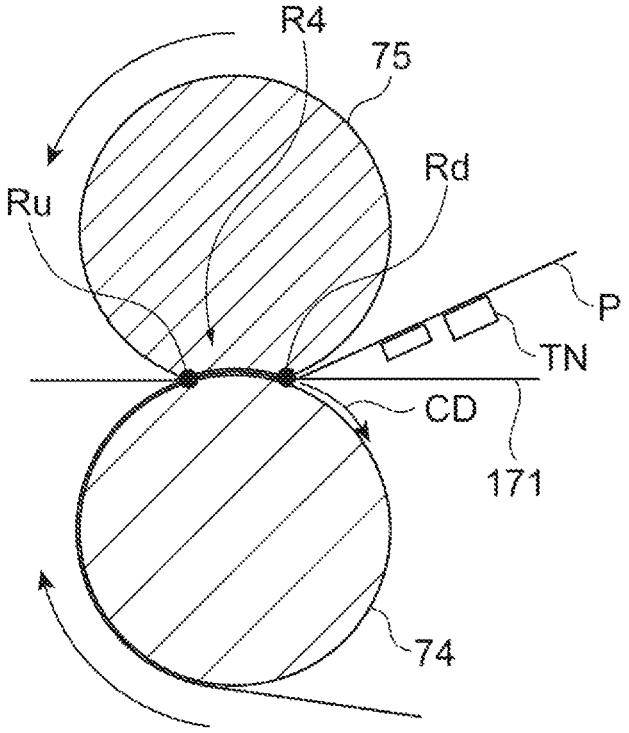
FIG. 6 is a partially enlarged view of the gloss treatment device illustrated in FIG. 5.

A gloss treatment device 170 according to a comparative example will be described with reference to FIGS. 5 and 6. FIG. 5 is a schematic diagram of the gloss treatment device 170 according to the comparative example. FIG. 6 is an enlarged partial view of the gloss treatment device 170 illustrated in FIG. 5, that illustrates a region near the nip portion R4.

With reference to FIG. 5, the gloss treatment device 170 according to the comparative example is similar to the gloss treatment device 70 in that a conveyor belt 171, the first roller 72, the second roller 73, the heating roller 74, the pressing roller 75, and the cooling device 76 are provided. In the gloss treatment device 70, with reference to FIG. 2, the conveyance portion 71*p* extends (along the heating roller 74) so as to be inclined toward the heating roller 74 in a downstream region in relation to the nip portion R4 of the conveyor belt 71. Referring back FIGS. 5 and 6, in the gloss treatment device 170 according to the comparative example, the conveyor belt 171 extends in a horizontal direction of the downstream region in relation to the nip portion R4 (a direction in alignment with the line connecting the nip portion entrance Ru and the nip portion exit Rd).

The sheet P in the nip portion R4 is conveyed along a curvature direction of the nip portion R4 and the sheet P in the nip portion exit Rd is conveyed in the circumferential direction CD (see FIG. 6) of the heating roller 74 normally engaging with the conveyor belt 171. However, in the gloss treatment device 170 according to the comparative example, since the conveyor belt 171 extends in the horizontal direction and does not extend in the circumferential direction CD of the heating roller 74, the conveyance of the sheet P in the circumferential direction CD is affected. In some cases, the sheet P having been interrupted in the conveyance operation may be displaced in a direction to separate from the conveyor belt 171 (an upward direction in the drawing, for example) as illustrated in FIG. 6 due to a counterforce (e.g. a force pushed back) from the conveyor belt 171. For example, the sheet P may be separated from the conveyor belt 171 when the releasing force of the sheet P having passed through the nip portion R4 exceeds the adhesion between the sheet P and the conveyor belt 171 due to the toner TN. The separation of the sheet P is likely to occur more easily when the toner amount (particularly at the sheet leading end side) is small or zero or the sheet is thin. When the sheet P is separated from the conveyor belt 171, the toner TN may not be solidified by the cooling device 76 while the toner TN is in close contact with the smooth conveyor belt 171, which may result in a decrease of the glossiness of the toner TN.

Referring back to FIG. 2, in the gloss treatment device 70, the conveyor belt 71 conveys the sheet P, the heating roller 74 heats the conveyor belt 71, the pressing roller 75 presses the conveyor belt 71 against the heating roller 74, and the cooling device 76 disposed adjacent to the conveyor belt 71 cools the conveyor belt 71. The nip portion R4 is formed in a region in which the conveyor belt 71 contacts both of the pressing roller 75 and the heating roller 74, and the conveyance portion 71*p* of the conveyor belt 71 extends toward the cooling device 76 so as to be inclined toward the heating roller 74 in relation to the line L1 (see FIG. 4) connecting the nip portion entrance Ru and the nip portion exit Rd in the conveyance direction of the sheet.

Since the conveyance portion 71*p* of the conveyor belt 71 is inclined toward the heating roller 74 and extends toward the cooling device 76, the conveyor belt 71 is inhibited from interfering with the conveyance operation of the sheet P in the circumferential direction CD (see FIG. 6) of the heating roller 74. Accordingly, the sheet P is inhibited or prevented from separating away from the conveyor belt 71. That is, according to the gloss treatment device 70, the toner TN is solidified by the cooling device 76 while the toner TN is in close contact with the smooth conveyor belt 71, to improve the glossiness of the toner TN.

In another configuration of a comparative example for improving the glossiness of the toner TN, the rear surface of the sheet having passed through the fixing nip by a roll or a belt may be restrained. Additional modifications to achieve such a comparative configuration, may increase cost and affect transportability. Further, in another configuration for improving the glossiness of the toner TN, the rear surface of the sheet having passed through the fixing nip may be cooled. Additional modifications to achieve this comparative configuration may lead to a cost increase. In yet another configuration for improving the glossiness of the toner TN the sheet may be maintained in close contact with the conveyor belt in an electrostatic state. Additional modifications to achieve such a comparative configuration, may lead to a cost increase. As compared with these comparative configurations, the gloss treatment device 70 may prevent an increase in cost and an impairment of the transportability.

As described above, in the gloss treatment device 70, the heating roller 74 is used as the heating portion for heating the conveyor belt 71 and the pressing roller 75 is used as the pressing portion for pressing the conveyor belt 71 against the heating roller 74. Accordingly, the nip portion R4 is suitably formed to melt the toner TN and to convey the sheet P.

Further, in the gloss treatment device 70, the conveyance portion 71*p* is located between the nip portion exit Rd and the cooling device 76 in the conveyance direction of the sheet P. According to such a configuration, the sheet P may be guided in the normal conveyance direction (the circumferential direction CD of the heating roller 74) before the sheet P coming out of the nip portion exit Rd reaches the cooling device 76, in order to better inhibit or prevent the sheet P from being separated from the conveyor belt 71 by the conveyance portion 71*p*.

In addition, the conveyance portion 71*p* includes the curved portion 71*a* which contacts the heating roller 74 and the linear portion 71*b* which linearly extends from the curved portion 71*a* toward the cooling device 76. According to such a configuration, the conveyance portion 71*p* (the conveyor belt 71) extends in a linear shape directed toward the cooling device 76 by a short distance at the downstream side of the nip portion exit Rd while a curved shape is formed in the circumferential direction CD of the heating roller 74 in a portion contacting the heating roller 74. Accordingly, the sheet P is suitably guided in the normal conveyance direction (the circumferential direction CD of the heating roller 74).

In addition, the conveyance portion 71*p* (specifically, the linear portion 71*b*) may extend linearly toward the cooling device 76 while following the tangent L2 of the nip portion exit Rd (see FIG. 4) or may be inclined toward the heating roller 74 in relation to the tangent L2 (e.g. the conveyance portion 71*p* may be aligned with the tangent L2 or angularly offset from the tangent L2 toward the heating roller 74). Since the linear portion 71*b* extends along the tangent L2 (or is inclined toward the heating roller 74 in relation to the tangent L2), the sheet P is more easily guided in the normal conveyance direction (the circumferential direction CD of the heating roller 74). Accordingly, the sheet P is better guided along the conveyor belt 71, and inhibited or prevented from separating from the conveyor belt 71.

Further, in the example gloss treatment device 70, the heating roller 74 is formed of a material having a hardness greater than that of the pressing roller 75. Accordingly, since the pressing roller 75 is formed in a depressed (recessed) shape in the nip portion R4 in which the heating roller 74 contacts the pressing roller 75, the adhesion degree of the heating roller 74 and the pressing roller 75 increases and hence the sheet P can be effectively pressed in the nip portion R4.

Figure 7:
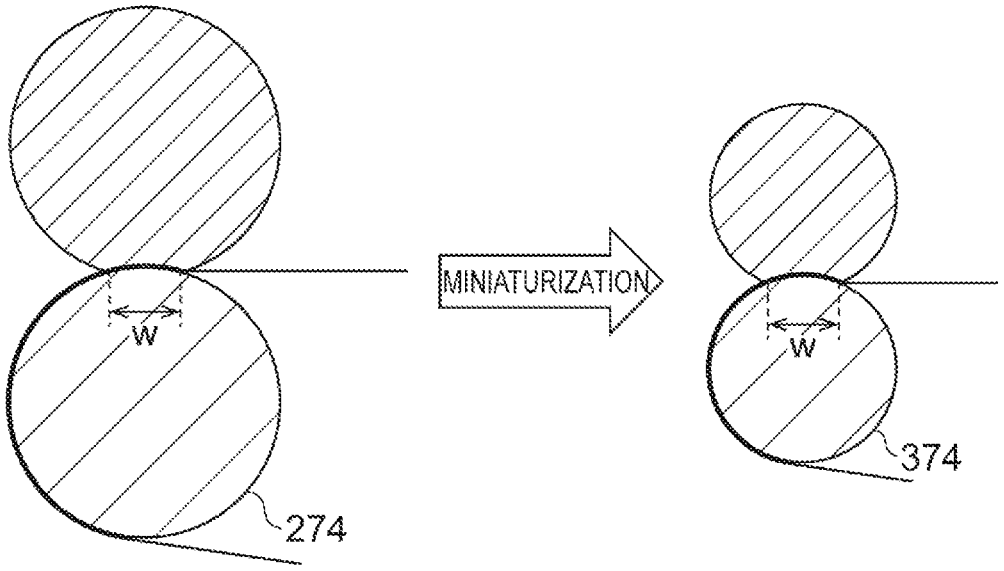
FIG. 7 is a schematic diagram illustrating a curvature of an example miniaturized heating roller.

Further, in the gloss treatment device 70, the diameter of the heating roller 74 is set to be less than 60 mm. In this way, when the heating roller 74 (and the corresponding pressing roller 75) is miniaturized, the apparatus can be decreased in size and the curvature increases. Accordingly, the sheet is more easily separated from the conveyor belt. FIG. 7 is a diagram that illustrates the curvature of the heating roller which is decreased in size. In FIG. 7, the heating roller 374 is illustrated as a miniaturized heating roller, for example, having a diameter less than 60 mm. The miniaturized heating roller 374 is shown in comparison with the larger heating roller 274 in FIG. 7. In the example illustrated in FIG. 7, the heating rollers 274 and 374 are set to have the same nip width W. Since the curvature of the miniaturized heating roller 374 increases as compared with the heating roller 274 even when the nip width W is the same, the sheet is more easily separated from the conveyor belt due to a counterforce (e.g. a force pushed back) from the conveyor belt extending horizontally. In the gloss treatment device 70, since the conveyor belt 71 does not disturb the conveyance operation of the sheet P in the circumferential direction CD of the heating roller 74 (see FIG. 6), the sheet P is inhibited or prevented from being separated from the conveyor belt 71 even when the diameter of the heating roller 74 is small. Accordingly, the gloss treatment device 70 may be miniaturized and still improve the glossiness of the toner TN.

Further, in the example gloss treatment device 70, the ratio of the nip width W with respect to the diameter D of the heating roller 74 is between 0.06 and 1. When the ratio of the nip width W with respect to the heating roller 74 is large, it is easier to miniaturize the apparatus and for the sheet P to separate from the conveyor belt 71. Since the conveyor belt 71 of the gloss treatment device 70 does not disturb the conveyance operation of the sheet P in the circumferential direction CD of the heating roller 74 (see FIG. 6), the sheet P is inhibited or prevented from being separated from the conveyor belt 71 even when the nip width W is set to be large to a certain extent with respect to the miniaturized heating roller 74. Accordingly, the gloss treatment device 70 may be decreased in size and still improve the glossiness of the toner TN at the same time.

It is to be understood that not all aspects, advantages and features described herein may necessarily be achieved by, or included in, any one particular example. Indeed, having described and illustrated various examples herein, it should be apparent that other examples may be modified in arrangement and detail.

Figure 8B:
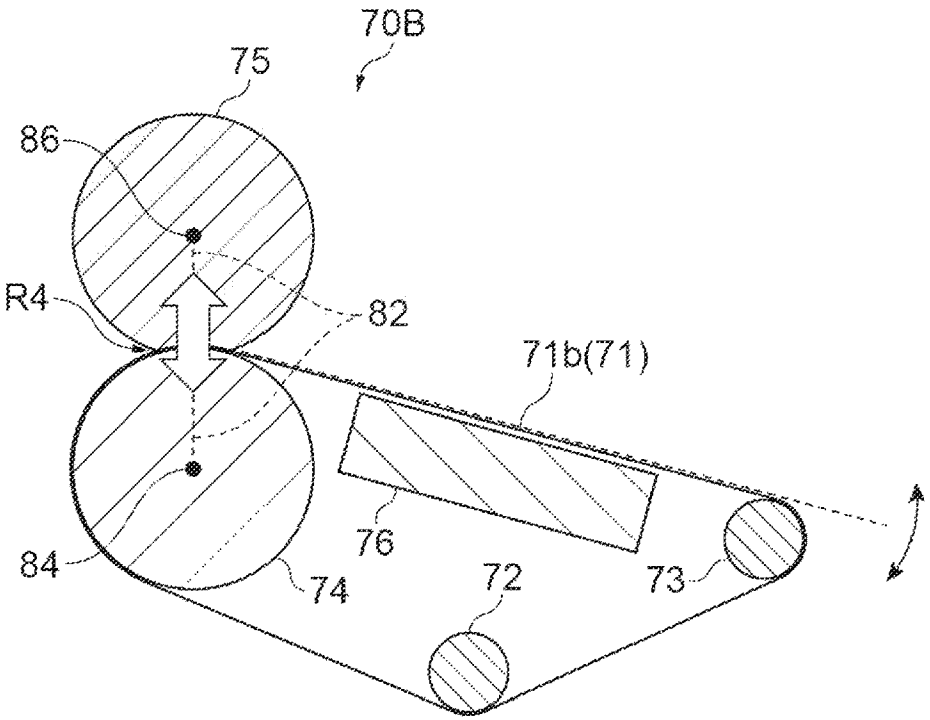
FIG. 8B is a schematic diagram of a gloss treatment device according to another modified example.
Figure 8A:
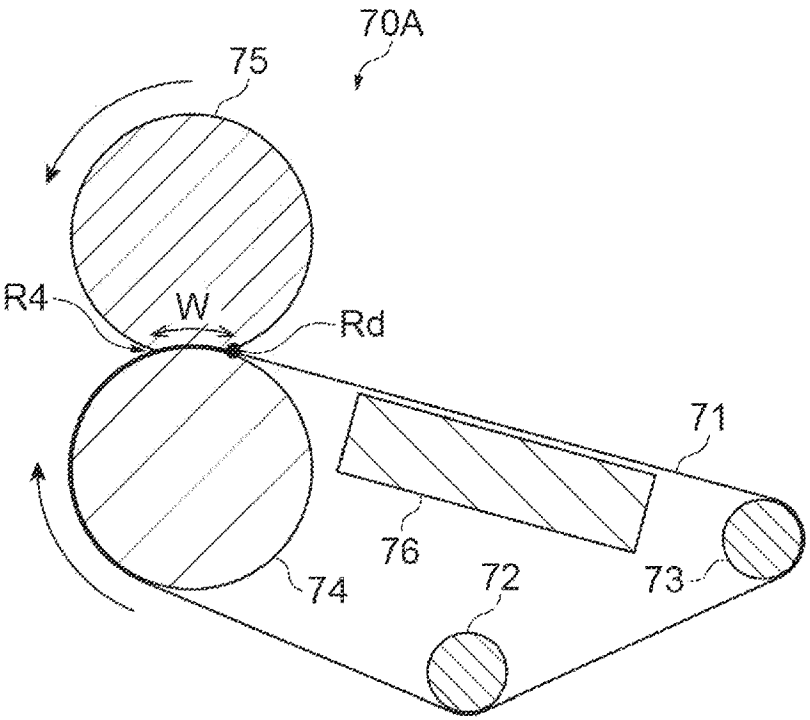
FIG. 8A is a schematic diagram of a gloss treatment device according to a modified example.

For example, FIGS. 8A and 8B are schematic diagrams of gloss treatment devices 70A and 70B of modified examples. In the example gloss treatment devices 70A and 70B, the nip width W corresponding to the width of the nip portion R4 is adjustable (changeable). Accordingly, even when there is a need to change the nip width W in accordance with the type (the thickness, size, and the like) of the sheet P, the glossiness of the toner TN can be improved by applying the technique of the gloss treatment device 70. Further, since a temperature, a surface pressure, and a nip width are parameters that affect the glossiness of the sheet P during a re-melting operation, the nip width may be suitably adjusted to improve the glossiness of the sheet P.

For example, the gloss treatment device 70A illustrated in FIG. 8A is provided with a drive unit that rotates the pressing roller 75 about the nip portion exit Rd as a rotation axis point and the nip width W is changed by rotating the pressing roller 75 about the nip portion exit Rd as a rotation axis point. In this way, in a configuration in which the nip width W is modifiable, the nip width W can be more easily and reliably adjusted (changed). For example, according to such a configuration, the pressing roller 75 may be rotated to adjust the nip width W, without affecting the extension angle of the conveyor belt 71.

Further, the gloss treatment device 70B illustrated in FIG. 8B is provided with a drive unit which moves at least one of the heating roller 74 and the pressing roller 75 in the up and down direction indicated by the large white arrow in FIG. 8B (e.g., along the extension direction of a line 82 intersecting the rotation shaft 84 of the heating roller 74 and the rotation shaft 86 of the pressing roller 75) and the nip width W is changed when at least one of the heating roller 74 and the pressing roller 75 is operated in the up and down direction. Even when at least one of the heating roller 74 and the pressing roller 75 is operated in a direction (the up and down direction in FIG. 8B) to separate the heating roller 74 and the pressing roller 75 from each other, the nip width W can be easily adjusted. The gloss treatment device 70 may be further provided with a drive unit which sets the inclination angle of the linear portion 71*b* of the conveyor belt 71 to an angle corresponding to the nip width W. Since the conveyance direction of the sheet P in the nip portion exit Rd is changed as the nip width W changes, the inclination angle of the linear portion 71*b* (for example, the tension angle of the conveyor belt 71) is adjusted based on the nip width W. Accordingly, the sheet P may be suitably guided based on various nip widths W and to prevent the sheet P from being separated from the conveyor belt 71. Further, the inclination angle of the linear portion 71*b* may be set to an angle corresponding to the nip width W and the diameter D of the heating roller 74, by operating a drive unit to adjust the inclination angle of the linear portion 71*b*. The conveyance direction of the sheet P in the nip portion exit Rd changes based on the nip width W and also on the diameter D of the heating roller 74. Since the inclination angle of the linear portion 71*b* is set based on the nip width W and the diameter D of the heating roller 74, the sheet P may be suitably guided based on various nip widths W and the diameter D of the heating roller 74 and to prevent the sheet P from being separated from the conveyor belt 71.

Although an example has been described in which the heating roller 74 is employed as the heating portion for heating the conveyor belt 71 and the pressing roller 75 is employed as the pressing portion for pressing the conveyor belt 71 against the heating roller 74, other configurations may be adopted. For example, either of the heating portion and the pressing portion may be provided by a belt instead of a roller. Further, as the heating portion, a heating member such as a planar heater, a halogen lamp, and an induction heater may be used. Furthermore, when the planar heater is used as the heating portion, an additional driving and tensioning roller may be provided for driving and/or tensioning the conveyor belt 71.

Figure 9:
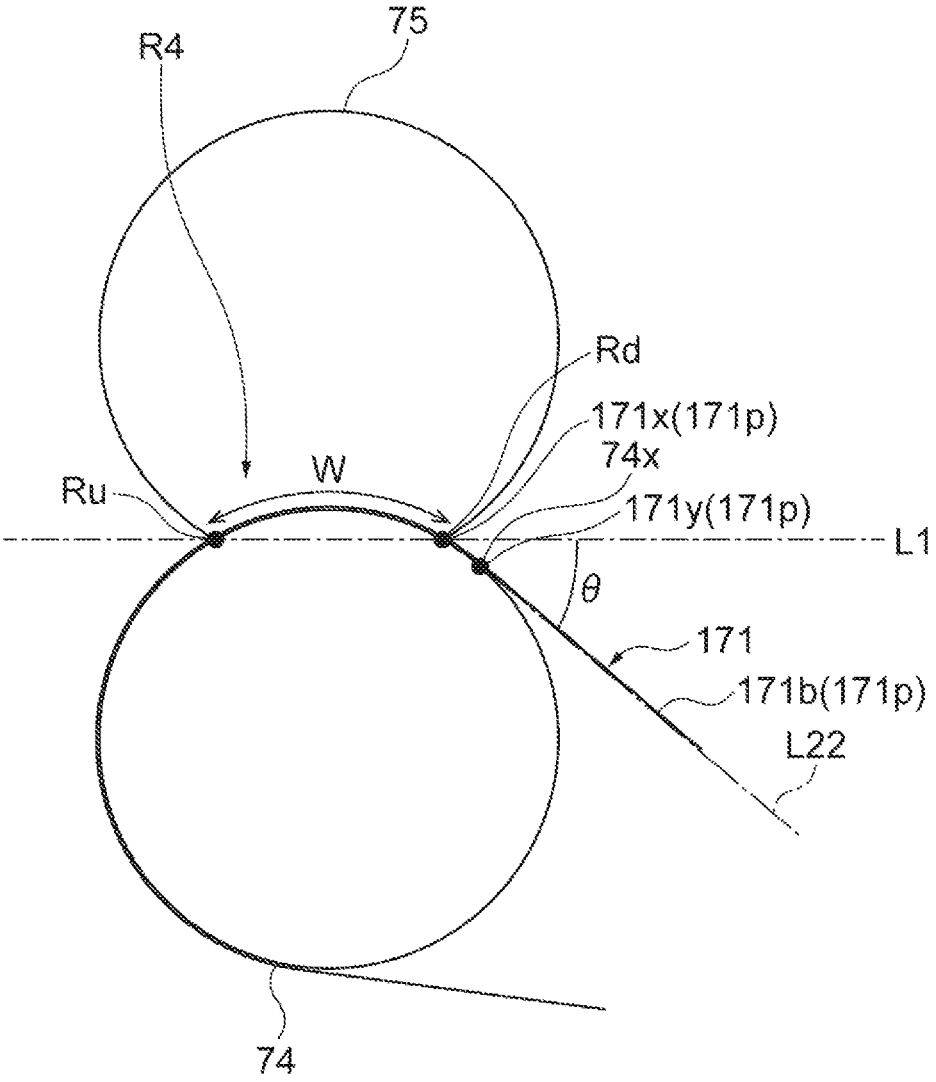
FIG. 9 is a schematic diagram of a conveyor belt according to another modified example.

FIG. 9 is a diagram illustrating an example conveyor belt 171 according to a modified example. In the conveyor belt 171, a conveyance portion 171*p* may include a first portion 171*x* and a second portion 171*y* that form a curved portion. The first portion 171*x* is a portion which contacts the heating roller 74 in the nip portion exit Rd. The second portion 171*y* is a portion which contacts the heating roller 74 at the downstream side of the nip portion exit Rd. In this way, the conveyance portion 171*p* includes a portion which extends to the downstream side of the nip portion exit Rd along the heating roller 74 (in a contact state e.g., where the conveyor belt 171 contacts the curved surface of the heating roller 74). The linear portion 171*b* of the conveyance portion 171*p* which is continuous to the second portion 171*y* (e.g. the conveyance portion 171*p* extends continuously from the second portion 171*y*), extends toward the cooling device along a tangent L22 of a contact point 74*x* of the heating roller 74 where the heating roller 74 contacts the downstream end of the second portion 171*y* of the conveyor belt 171. In such a configuration, since the conveyance portion 171*p* extends further along the heating roller 74 (e.g., beyond the nip portion exit Rd), it is easier to guide the sheet P in the normal conveyance direction (the circumferential direction CD of the heating roller 74). Accordingly, it is possible to better inhibit or prevent the sheet P from being separated from the conveyor belt 171.

The invention claimed is:

1. An imaging system comprising:

an endless belt to convey a medium along a conveyance direction;

a heating roller to heat the endless belt;

a pressing portion to press the endless belt against the heating roller, wherein a nip portion is formed in a region where the endless belt contacts both of the pressing portion and the heating roller, wherein the nip portion includes an upstream end and a downstream end in the conveyance direction, and wherein a reference line intersects the upstream end and the downstream end of the nip portion; and a cooling portion located adjacent to the endless belt to cool the endless belt, wherein the endless belt includes a conveyance portion extending toward the cooling portion, wherein the conveyance portion is inclined toward the heating roller in relation to the reference line associated with the nip portion, wherein the conveyance portion includes a curved portion that contacts the heating roller and a linear portion that extends linearly from the curved portion toward the cooling portion, and wherein an inclination angle of the linear portion of the conveyance portion, toward the heating roller and relative to the reference line, is set to an angle that is based on a nip width of the nip portion.

2. The imaging system of claim 1, wherein the conveyance portion extends toward the cooling portion so as to follow a tangent of the heating roller at the downstream end of the nip portion or to be inclined toward the heating roller relative to the tangent.

3. The imaging system of claim 1, wherein the conveyance portion extends between the downstream end of the nip portion and the cooling portion in the conveyance direction.

4. The imaging system of claim 1, wherein the curved portion includes a first portion that contacts the heating roller at the downstream end of the nip portion and a second portion to contact the heating roller at a downstream side of the nip portion, in the conveyance direction.

5. The imaging system of claim 1, wherein the nip width corresponds to a width of the nip portion from the upstream end to the downstream end, and wherein the nip width is changeable.

6. The imaging system of claim 1, wherein the pressing portion is a pressing roller.

7. The imaging system of claim 6, wherein at least one of the heating roller and the pressing roller is movable to adjust the nip width.

8. The imaging system of claim 4, wherein the heating roller and the pressing roller are movable along an extension direction of a line that intersects a rotational axis of the heating roller and a rotational axis of the pressing roller to adjust the nip width.

9. The imaging system of claim 1, wherein the inclination angle of the linear portion of the conveyance portion, toward the heating roller and relative to the reference line, is set to the angle that is further based on a diameter of the heating roller.

10. The imaging system of claim 6, wherein the heating roller is formed of a material having a hardness greater than that of the pressing roller.

11. The imaging system of claim 1, wherein a diameter of the heating roller is less than 60 millimeters (mm).

12. An imaging system comprising:

an endless belt to convey a medium along a conveyance direction;

a heating roller to heat the endless belt;

a pressing portion to press the endless belt against the heating roller, wherein a nip portion is formed in a region where the endless belt contacts both of the pressing portion and the heating roller, wherein the nip portion includes an upstream end and a downstream end in the conveyance direction, and wherein a reference line intersects the upstream end and the downstream end of the nip portion, wherein a ratio of a nip width of the nip portion with respect to a diameter of the heating roller is between 0.06 and 1; and a cooling portion located adjacent to the endless belt to cool the endless belt, wherein the endless belt includes a conveyance portion extending toward the cooling portion, wherein the conveyance portion is inclined toward the heating roller in relation to the reference line associated with the nip portion.

13. A gloss treatment device comprising:

an endless belt to convey a medium in a conveyance direction;

a heating roller engaging the endless belt; and a pressure roller to press the endless belt against the heating roller at a nip region where the endless belt is in contact with both the pressure roller and the heat-heating roller, wherein the nip region includes an upstream end and a downstream end in the conveyance direction, and wherein a first plane intersects the upstream end and the downstream end of the nip region; and a cooling portion adjacent the endless belt to cool the endless belt, wherein the endless belt comprises a conveyance portion extending toward the cooling portion, wherein the conveyance portion is inclined toward the heating roller in relation to the first plane, wherein the conveyance portion includes a curved portion that contacts the heating roller and a linear portion that extends linearly from the curved portion toward the cooling portion, and wherein an inclination angle of the linear portion of the conveyance portion, toward the heating roller and relative to the first plane, is set to an angle that is based on a nip width of the nip region.

14. The gloss treatment device of claim 13, wherein a ratio of the nip width of the nip region with respect to a diameter of the heating roller is between 0.06 and 1.

15. The gloss treatment device of claim 13, wherein the heating roller is formed of a material having a hardness greater than that of the pressure roller.

16. The gloss treatment device of claim 13, wherein the inclination angle of the linear portion of the conveyance portion, toward the heating roller and relative to the first plane, is set to the angle that is further based on a diameter of the heating roller.

17. The gloss treatment device of claim 13, wherein the linear portion is located on a downstream side of the heating roller in the conveyance direction.

18. The gloss treatment device of claim 17, wherein the linear portion extends from the heating roller along a second plane that is angularly offset from the first plane.

* * * * *